US008800417B2

(12) United States Patent
Masson et al.

(10) Patent No.: US 8,800,417 B2
(45) Date of Patent: Aug. 12, 2014

(54) METHOD FOR OPERATING A MACHINE FOR PLAITING REINFORCING FIBERS

(75) Inventors: Richard Masson, Les Loges en Josas (FR); Romain Boudier, Versailles (FR); Jean-Pierre Mattei, La Varenne Saint-Hilaire (FR); Victor Bras Pereira, Vitry sur Seine (FR)

(73) Assignee: Messier-Bugatti-Dowty, Velizy Villacoublay (FR)

( * ) Notice: Subject to any disclaimer, the term of this patent is extended or adjusted under 35 U.S.C. 154(b) by 64 days.

(21) Appl. No.: 13/579,725

(22) PCT Filed: Feb. 11, 2011

(86) PCT No.: PCT/EP2011/000659

§ 371 (c)(1), (2), (4) Date: Jan. 16, 2013

(87) PCT Pub. No.: WO2011/101110

PCT Pub. Date: Aug. 25, 2011

(65) Prior Publication Data

US 2013/0133508 A1 May 30, 2013

(30) Foreign Application Priority Data

Feb. 18, 2010 (FR) ..... 10 51170

(51) Int. Cl.
*D04C 3/48* (2006.01)
*D04C 3/40* (2006.01)

(52) U.S. Cl.
CPC ... *D04C 3/48* (2013.01); *D04C 3/40* (2013.01)
USPC ..... 87/34

(58) Field of Classification Search
CPC ..... D04C 3/48
USPC ..... 87/34
See application file for complete search history.

(56) References Cited

U.S. PATENT DOCUMENTS 4,494,436 A 1/1985 Kruesi
4,519,290 A * 5/1985 Inman et al. ..... 87/7
4,846,908 A * 7/1989 Aldrich et al. ..... 156/148

(Continued)

FOREIGN PATENT DOCUMENTS

EP 0 285 156 A2 10/1988
EP 0 307 112 A2 3/1989
EP 0 617 154 A1 9/1994

OTHER PUBLICATIONS

International Search Report for PCT/EP2011/000659, dated Jun. 9, 2011.

*Primary Examiner* — Shaun R Hurley
(74) *Attorney, Agent, or Firm* — Sughrue Mion, PLLC

(57) ABSTRACT

The invention relates to a method for the operation of a plaiting machine (1) that comprises a ring (2) carrying fiber spools (3) for plaiting layers (16, 22) of fibers (3) about a mandrel (13, 17) carried by a carrier (12) capable of movement along the axis (AX) of the ring (2), wherein after plaiting the fibers (3) are cut in order to withdraw the mandrel (13, 17), and that comprises: a hub (5, 6; 18) carried by the carrier (12) and secured to the mandrel (13; 17) while being mounted upstream therefrom; an operation for tightening the fibers (3) around the hub (5, 6; IS) with a link (11, 14) surrounding said fibers (3) after the mandrel (13, 17) has passed through the ring (2); and in which the fibers (3) are cut between the mandrel (13, 17) and the hub (5, 6; 18) before withdrawing the mandrel (13, 17).

4 Claims, 3 Drawing Sheets

(56) References Cited

U.S. PATENT DOCUMENTS

| | | | | |
|---|---|---|---|---|
| 5,016,516 | A * | 5/1991 | Aldrich et al. | 87/8 |
| 5,203,249 | A * | 4/1993 | Adams et al. | 87/34 |
| 5,388,497 | A * | 2/1995 | Akiyama et al. | 87/34 |
| 5,398,586 | A * | 3/1995 | Akiyama et al. | 87/6 |
| 6,024,005 | A * | 2/2000 | Uozumi | 87/34 |
| 7,500,345 | B2 * | 3/2009 | Kish | 57/138 |
| 8,511,214 | B2 * | 8/2013 | Gries | 87/34 |
| 2013/0133508 | A1 * | 5/2013 | Masson et al. | 87/34 |

* cited by examiner

METHOD FOR OPERATING A MACHINE FOR PLAITING REINFORCING FIBERS

CROSS REFERENCE TO RELATED APPLICATIONS

This application is a National Stage of International Application No. PCT/EP2011/000659 filed on Feb. 11, 2011, which claims priority from French Patent Application No. 1051170, filed on Feb. 18, 2010, the contents of all of which are incorporated herein by reference in their entirety.

The invention concerns a method of operating a braiding machine including a ring carrying spools of reinforcing fibers to braid successively a plurality of layers of reinforcing fibers around the same mandrel moved several times through the ring or around a plurality of mandrels moved one after the other through the ring.

BACKGROUND OF THE INVENTION

A braiding machine enables a composite material part to be fabricated by braiding around a mandrel and over the whole of its length one or more layers of reinforcing fibers superposed one on the other.

Once the various layers have been formed, the assembly constituted by the mandrel and the layers that it is carrying is placed in a mold to inject resin into these layers. This resin is then polymerized, for example by heating, to constitute a raw rigid part.

Such a braiding machine 1, which is represented in FIG. 1, essentially includes a ring 2 lying in a vertical plane, the revolution axis AX of this ring thus being horizontal. This ring 2 carries a set of spools of reinforcing fibers 3 that converge toward a point or a region situated on the axis AX and in front of the plane of the ring. These fibers thus conjointly define a generally conical shape.

When the braiding cycle is started, the mandrel 4 is moved along the axis AX to pass through the ring 2 beyond the point of convergence of the fibers. At the same time, the spools carried on the ring 2 by motorized mobile supports are actuated to fabricate a sock of reinforcing fibers on the external face of this mandrel 4.

This sock covers the mandrel over the whole of its length once it has passed completely through the ring, i.e. once it is situated beyond the point of convergence of the fibers, which is itself offset relative to the ring.

The layer of reinforcing fibers is then cut downstream of the mandrel and the mandrel is demounted and then replaced behind the ring, in order to pass through it again for the formation of a second layer of reinforcing fibers radially superposed on the first.

In practice, the mandrel has its downstream end rigidly fastened to a rear rod and its upstream end rigidly fastened to a front rod by means of which it is pulled through the ring. The mandrel may to this end include at each of its ends a threaded hole, each rod then having a corresponding threaded end that is screwed into this threaded hole.

In operation, the layer of braided fibers surrounds the front rod, and is formed around the mandrel as the latter is pulled forward along the axis AX by this rod.

When this layer has been completely formed, a cord is passed through the braid, downstream of the mandrel, and this cord is tensioned parallel to the axis AX to maintain the point of convergence of the fibers in front of the ring and approximately on the axis AX.

The reinforcing fiber braid may then be cut between the mandrel and the region in which the cord passes through it.

After this step, the front rod is unscrewed from the front end of the mandrel and the mandrel is unscrewed from the front end of the rear rod and extracted with the layer of reinforcing fibers that it is carrying.

The mandrel with the layer of fibers is then installed behind the ring again. The rear end of the rod that passes through the ring is then screwed into the front end of the mandrel and this rod, which was the rear rod in the previous step, then becomes the front rod.

Another rod is screwed to the rear end of the mandrel. These rods that are fastened to the mandrel are moreover retained in position on the axis AX by means of a plurality of bearings spaced from each other along the axis AX.

In practice, when the point of convergence of the fibers is held by the cord during removal and reinsertion of the mandrel, the position of this point of convergence is insufficiently well controlled to be sure that it remains centered on the axis AX, with the result that this point of convergence is offset radially relative to the axis AX.

Accordingly, when the mandrel is again installed in the machine and its front end is brought to bear against the area of convergence of the fibers, the radial offset of this area of convergence results in localized disorganization of the reinforcing fibers at the level of the end of the mandrel. The mechanical strength of the raw part produced is then significantly penalized at the level of this end.

One way to prevent this problem consists in operating the braiding machine so as to recenter the area of convergence of the carbon fibers before proceeding to remount the mandrel. However, this solution is costly in terms of fabrication time and increases the length of reinforcing fibers necessary for braiding each layer.

OBJECT OF THE INVENTION

The object of the invention is to propose a solution to remedy this drawback.

SUMMARY OF THE INVENTION

To this end, the invention consists in a method of operating a braiding machine including a ring carrying spools of reinforcing fiber for successively braiding a plurality of layers of reinforcing fibers around the same mandrel moved several times through the ring or around a plurality of mandrels moved one after the other through the ring, each mandrel being carried by a support movable through the ring along the axis of the ring, in which method, after passing a mandrel through the ring, the reinforcing fibers are cut downstream of this mandrel to be able to remove it, characterized in that:

- a hub carried by the support and fastened to the mandrel is mounted downstream of the latter;
- the reinforcing fibers are tightened around the hub by means of a tie around these reinforcing fibers after passing the mandrel through the ring; and
- the reinforcing fibers are cut between the mandrel and the hub before removing the mandrel.

With this solution, the fibers can be held perfectly centered on the axis of the ring during removal of a mandrel. The fabrication cost is therefore reduced since it is no longer necessary to actuate the braiding machine to recenter the braid prior to the installation of a new mandrel.

The invention also concerns a method as defined above wherein a hub is used including at least one circumferential groove forming an imprint in which is accommodated the tie for attaching the reinforcing fibers.

The invention also concerns a method as defined above wherein a hub is used having a shape that is at least partly conical.

The invention also concerns a method as defined above wherein a hub is used having a biconical shape.

The invention also concerns a method as defined above wherein the hub has ends of different sections corresponding to the sections of a mandrel mounted upstream of this hub and a mandrel mounted downstream of this hub.

The invention also concerns a method as defined above wherein the support of the mandrel and the hub is formed by one or more rods extending along the axis and carried by at least two bearings situated on either side of the ring.

DETAILED DESCRIPTION OF THE INVENTION

The basic idea of the invention is to mount a hub on the axis AX downstream of the mandrel and to use this hub to keep the area of convergence of the reinforcing fibers centered on the axis AX when removing the mandrel. In concrete terms, once the layer of fibers has been braided over the whole of the length of the mandrel, a tie or collar is placed and tightened around the fibers to clamp them against the hub in order to keep the area of convergence of these fibers centered on the axis AX.

Figure 1:
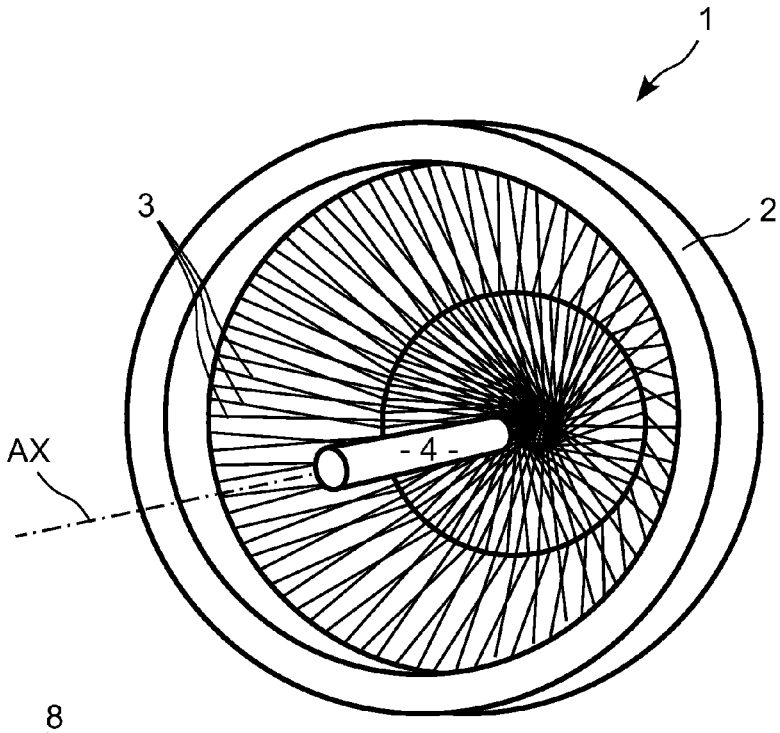
FIG. 1 is a perspective view showing the braiding of a layer of carbon fibers around a mandrel by means of a braiding machine.
Figure 2:
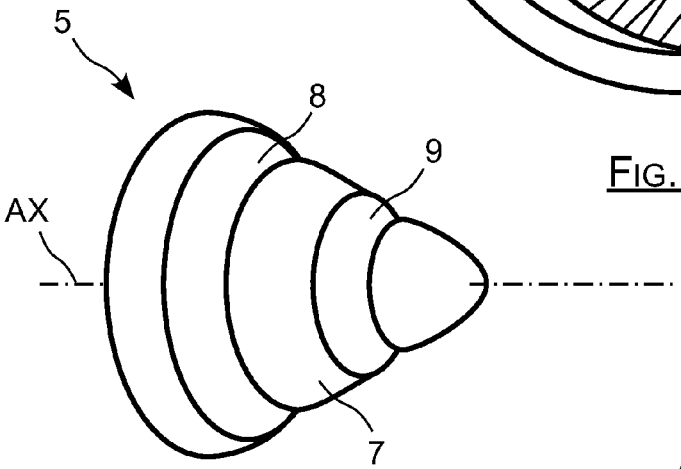
FIG. 2 is a perspective view of the hub of the method of the invention.

The hub 5, which is shown on its own in FIG. 2, has a general shape of revolution about the axis AX. Here its external surface is generally conical and it includes two circumferential grooves 8 and 9 spaced from each other along the axis AX.

Each groove 8, 9 constitutes a housing designed to receive a tie fitting tightly around the hub with the fibers surrounding the hub, so that this tie cannot slide along the external surface 7 when it has been tightened sufficiently to hold the area of convergence of the fibers in position.

Figure 3:
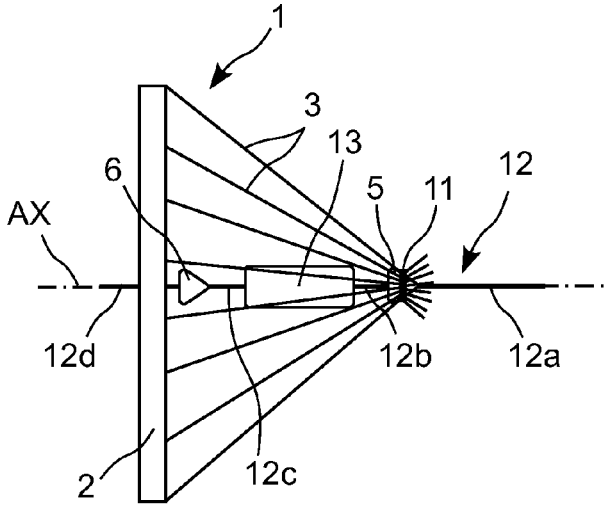
FIG. 3 shows diagrammatically a step of the method of the invention in which the reinforcing fibers are assembled and tightened around the hub.

In practice, and as can be seen in FIG. 3, the reinforcing fibers 3 conjointly extend in a conical shape, the apex of which situated on the axis AX corresponds to their area of convergence. When the hub 5 is situated at the level of this area along the axis AX, it is surrounded by the reinforcing fibers, which then bear on its external face.

In this situation, by being clamped onto them, a tie or collar 11 around these fibers in line with one of the grooves 8 or 9 on the hub 5 enables these reinforcing fibers to be retained in position so that their area of convergence is kept on the axis AX with no radial offset.

FIG. 3 shows more particularly a braiding installation 1 at the beginning of a braiding operation. This installation includes a ring 2 carrying a series of spools of reinforcing fibers 3, a support 12 carrying a mandrel 13 and a first hub 5 and a second hub 6 forming an assembly extending along the axis AX.

The first hub 5 is situated beyond the front end of the mandrel 13, namely at the end of the mandrel that is farthest away from the ring 2, toward the right in the figure. The second hub 6 is for its part situated in line with the rear end of the mandrel 13.

The reinforcing fibers 3 are all clamped around the hub 5 by the tie 11 and the mandrel 13 is situated in the internal space delimited by the conical surface that the reinforcing fibers 3 form, for the purpose of braiding a sock of reinforcing fibers around this mandrel and over the whole of its length.

The support 12 may be constituted by four rods 12*a*, 12*b*, 12*c*, 12*d*. In this case, each rod has both ends threaded and each end of the mandrel 13 and of each of the hubs 5 and 6 includes a threaded hole into which a rod end is screwed.

Assembling the rods with the mandrel 13 and the hubs 5 and 6 consists in screwing one end of the rod 12*a* to the front end of the hub 5, screwing the front end of the rod 12*b* to the rear end of the hub 5, and screwing the rear end of the rod 12*b* to the front end of the mandrel 13. In a similar manner, the front end of the rod 12*c* is screwed to the rear end of the mandrel 13, the rear end of the rod 12*c* is screwed to the front end of the hub 6, and, finally, the front end of the rod 12*d* is screwed to the rear end of the hub 13.

The assembly constituted by the mandrel 13, the two hubs 5, 6 and the rods 12*a*-12*c* constitutes a rigid whole held in position on the axis AX on the one hand by a first bearing at the rear, not shown, that is situated to the rear of the ring 2, i.e. to the left of the ring in the figure, and on the other hand by traction means, not shown, to which the front end of the rod 12*a* is fastened.

This bearing includes a fixed frame, optionally removable, comprising in its upper part members adapted to receive a rod to hold it in position on the axis AX and immobilizing it at least in rotation and possibly in translation. The traction means similarly include members receiving the rod and holding it in position on the axis AX, with translation and rotation locking members for pulling this rod along the axis AX.

The braiding operation is begun by moving the rigid assembly constituted by the support 12 with the mandrel 13 and the hubs 5 and 6 forward, i.e. toward the right in FIG. 3, by actuation of the traction means that are not shown.

Figure 4:
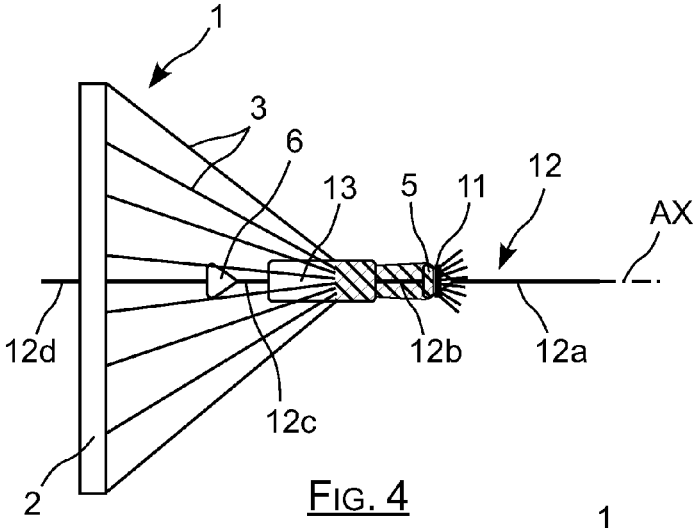
FIG. 4 shows a step of fabrication of a first layer of reinforcing fibers around the mandrel.

A sock is then braided around the mandrel in line with the point of convergence of the fibers, as the mandrel is moved, as shown diagrammatically in FIG. 4, in which approximately half the sock has been braided, the point of convergence of the reinforcing fibers then being situated substantially half way along the mandrel.

Figure 5:
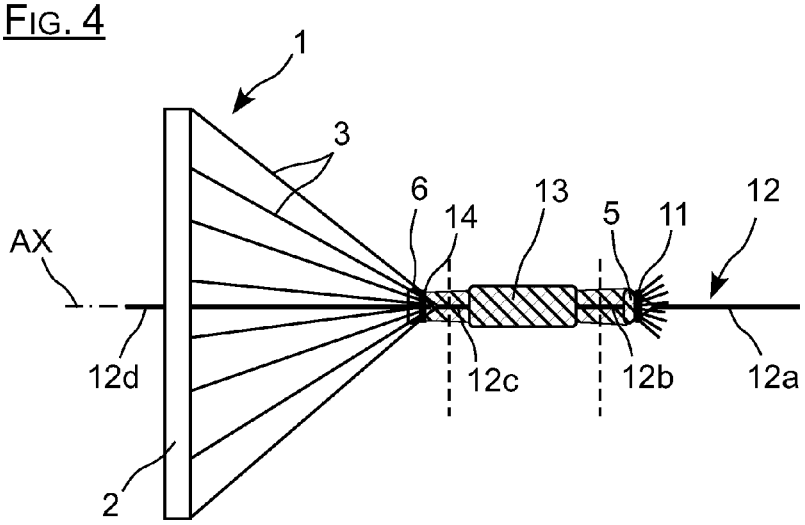
FIG. 5 shows a step of the method in which the fibers are tightened around the hub mounted downstream of the mandrel and the braided fibers are cut upstream and downstream of the mandrel.
Figure 6:
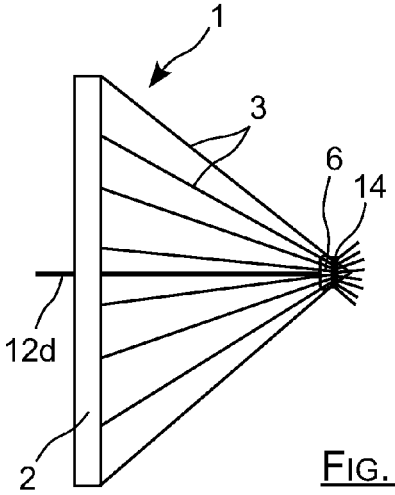
FIG. 6 shows a step of the method of the invention corresponding to the removal of the mandrel with the braided layer that it is carrying.

As this movement continues, the layer of reinforcing fibers is formed over the whole of the length of the mandrel 13, until the second hub 6 is in line with the area of convergence of the fibers, which corresponds to the FIG. 5 situation.

The installation is then stopped, and a tie or a collar 14 is passed around the second mandrel 6 to hold the reinforcing fibers in position at the level of their area of convergence. Once this operation has been effected, the braided layer 16 of reinforcing fibers is cut on the one hand between the front end of the mandrel 13 and the first hub 5 and on the other hand between the rear end of the mandrel 13 and the second hub 6. These cuts are made by means of scissors or similar type cutting tools.

When the layer of reinforcing fibers has been cut upstream and downstream of the mandrel 13, the mandrel is removed. In concrete terms, a second or rear bearing is advantageously installed temporarily to the rear of the ring 2, complementing the first rear bearing and being spaced therefrom along the axis AX, to hold the rod 12*d* completely in position on the axis AX. This rod 12*d* being the one that is carrying the second hub 6, its retention by the two rear bearings is sufficient to hold the area of convergence of the fibers 3 in position on the axis AX with no radial offset.

At this stage, the rod 12*a* is uncoupled from the traction means that are not shown so that the assembly formed by the rod 12*c*, the mandrel 13 with the layer that it is carrying, and the rods 12*b* and 12*a* may be unfastened from the second hub 6 by unscrewing the rear end of the rod 12*c* that is screwed into the front end of this hub 6.

The rod 12*a* can then be demounted by unscrewing it from the front end of the first hub 5. After this, this rod 12*a* is on the one hand screwed into the front end of the second hub 6 and on the other hand coupled again to the traction means that are not shown. In a complementary way, one or two additional front bearings are advantageously installed temporarily to hold this rod 12*a* coaxial with the axis AX.

At this stage, the rod 12*d* is demounted by unscrewing it from the rear end of the second hub 6, this second hub 6 then being held by the front hub 12*a* that is itself carried by the traction means and the temporarily installed front bearings.

The first hub 5 is then unscrewed from the front end of the rod 12*b* and then screwed into the rear end of the rod 12*c*. The assembly formed by, successively, the first hub 5, the rod 12*c*, the mandrel 13 and the hub 12*b* is then installed by screwing the front end of the rod 12*b* into the rear end of the second hub 6 and then screwing the front end of the rod 12*d* into the rear end of the first hub 5.

At this stage, the disposition of the installation again corresponds to that of FIG. 3, except that the positions of the first hub 5 and the second hub 6 are reversed relative to that which they occupy in FIG. 3.

The braiding of a new layer of reinforcing fibers superposed on the first may then begin, if necessary after removing the front and rear bearings which have been installed temporarily. Different layers are then braided onto the mandrel until a predetermined thickness is reached.

In the example shown in the figures, the hubs 5 and 6 are separated from the mandrel 13 by a relatively large distance, but this distance can advantageously be smaller, enabling the length of the reinforcing fibers necessary for each layer, and therefore the cost of fabrication, to be reduced.

Figure 7:
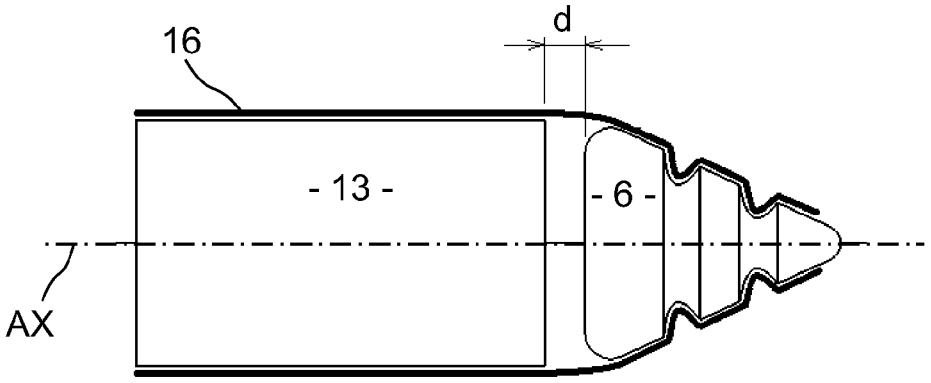
FIG. 7 is a lateral view showing the mandrel and the hub in section.

Accordingly, as shown in FIG. 7, the distance separating each hub from the mandrel may be reduced to a minimum value d that substantially corresponds to the minimum space necessary for the tool for cutting the layer of reinforcing fibers.

In the example shown in the figures, the hub 5 includes two grooves for clamping the reinforcing fibers in two corresponding ties or collars, but a solution including only one groove may also be satisfactory, the choice of the number of grooves and collars or ties being essentially conditioned by the fabrication conditions.

Figure 8:
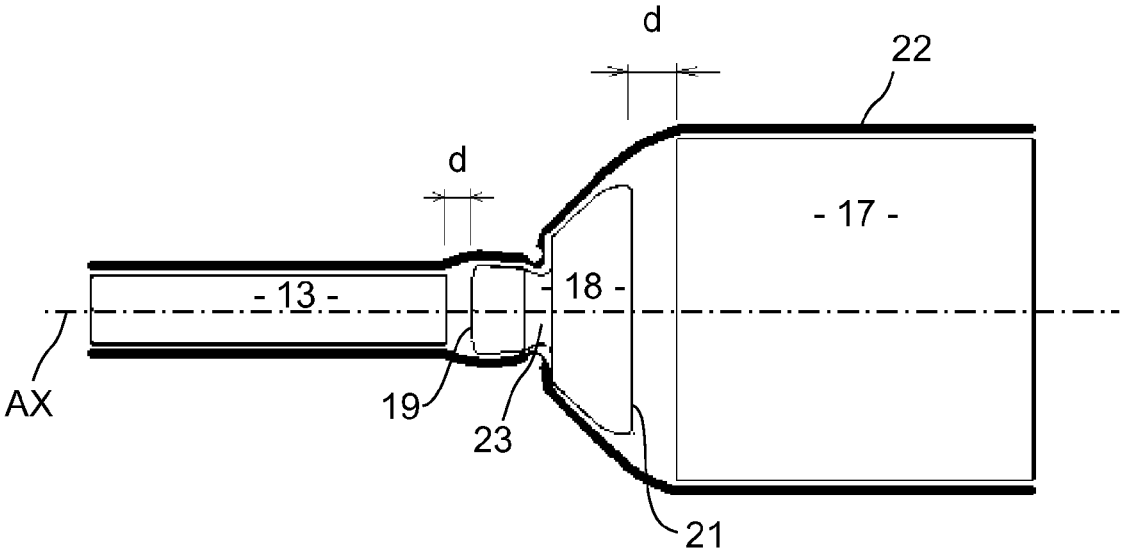
FIG. 8 is a lateral view showing in section another mandrel and another hub associated with that mandrel.

In the same way, the exterior shape of the hub 5 is also chosen as a function of fabrication conditions. In the FIG. 8 example the hub 18 is disposed between two consecutive mandrels 13 and 17 having different diameters that are mounted one after the other on the support.

Under these conditions, the hub 18 has a biconical shape and features at its end 19 nearest the mandrel 13 a section corresponding to that of the mandrel 13 and at its end 21 nearest the mandrel 17 a section corresponding to the section of that mandrel 17. The external surface of the hub 18 connects the contours of these two sections, whilst defining in its central region a constriction 23 constituting a groove designed to receive a tie for attaching the reinforcing fibers of the braided layer 22.

The diameter of the end 19 is advantageously significantly less than the diameter of the mandrel 13 and, conversely, the diameter of the end 21 is advantageously significantly greater than the diameter of the mandrel 17, so as to spread the braid to facilitate mounting this mandrel 17 between the two braiding operations.

This hub makes it possible to ensure continuity of the braided layer 22 between the first mandrel 13 and the second mandrel 17 so that the orientation of the fibers is not disturbed by the transition from one mandrel to the other.

As in the FIG. 7 example, the hub 18 is separated from each of the mandrels 13 and 17 by a distance d that corresponds to the minimum space for a tool for cutting the layer of reinforcing fibers.

Moreover, it is to be noted that in the FIG. 7 example the hub has an asymmetrical biconical shape. However, a hub having a biconical shape symmetrical with respect to its center could be suitable for some fabrication situations, notably when layers of reinforcing fibers are braided around different mandrels of the same diameter.

In the various examples shown in the figures, the mandrels have simple shapes of revolution, as do the hubs, but the invention also applies to situations in which the mandrel or mandrels has or have any other section, for example rectangular sections, in which case the hub or hubs used also have other sections corresponding to those of the mandrels.

If the mandrels and hubs have shapes that are not shapes of revolution, it is advantageous to ensure that these elements are not able to turn about the axis AX during the formation of the layer of reinforcing fibers. There may then be provision for the coupling between each support rod and each mandrel or hub to incorporate a transverse key passing through the end of the element concerned and the rod to prevent rotation of each element relative to the rod.

The invention claimed is:

1. A method of operating a braiding machine including a ring carrying spools of reinforcing fiber for successively braiding a plurality of layers of reinforcing fibers around a unique mandrel moved several times through the ring or around a plurality of mandrels moved one after the other through the ring, each mandrel being carried by a support movable through the ring along an axis of the ring, the method comprising:

passing the mandrel through the ring at least one time;

tightening the reinforcing fibers downstream of the mandrel around a hub fastened to and downstream of the mandrel, by means of a tie which is accommodated in a circumferential groove forming an imprint in the hub; and cutting the reinforcing fibers between the mandrel and the hub before removing the mandrel.

2. A method of operating a braiding machine including a ring carrying spools of reinforcing fiber for successively braiding a plurality of layers of reinforcing fibers around the same mandrel moved several times through the ring or around a plurality of mandrels moved one after the other through the ring, each mandrel being carried by a support movable through the ring along the axis (AX) of the ring, the method comprising:

passing the mandrel through the ring at least one time;

tightening the reinforcing fibers downstream the mandrel around a hub fastened to and downstream the mandrel, the hub having at least partly a conical shape; and cutting the reinforcing fibers between the mandrel and the hub before removing the mandrel.

3. The method claimed in claim 2, wherein the hub has a biconical shape.

4. The method claimed in claim 3, wherein the hub has ends of different sections corresponding to sections of a mandrel mounted upstream of the hub and a mandrel mounted downstream of the hub.

* * * * *